United States Patent [19]

Raaz

[11] 4,083,267

[45] Apr. 11, 1978

[54] FUEL CONTROL DEVICE FOR INTERNAL COMBUSTION ENGINE

[76] Inventor: Paul John Raaz, Rte 1, Box 69, Shiner, Tex. 77984

[21] Appl. No.: 742,435

[22] Filed: Nov. 17, 1976

[51] Int. Cl.[2] ..... F02M 7/12; F02D 31/00

[52] U.S. Cl. ..... 74/860; 123/DIG. 11; 123/97 B; 123/102; 123/198 DC

[58] Field of Search ..... 123/198 DB, 198 D, 102, 123/97 B, DIG. 11; 74/860, 858, 872; 261/DIG. 74

[56] References Cited

U.S. PATENT DOCUMENTS

| | | | |
|---|---|---|---|
| 3,158,144 | 11/1964 | Walker | 123/DIG. 11 |
| 3,310,044 | 3/1967 | Haverotich | 123/97 B |
| 3,690,305 | 9/1972 | Shimada et al. | 123/102 X |
| 3,702,603 | 11/1972 | Baxendale et al. | 123/102 X |
| 3,756,208 | 9/1973 | Toda et al. | 123/97 B |
| 3,782,346 | 1/1974 | Tatsufomi et al. | 123/97 B |
| 3,996,908 | 12/1976 | Brown et al. | 123/97 B X |

*Primary Examiner*—Charles J. Myhre

*Assistant Examiner*—Ira S. Lazarus

*Attorney, Agent, or Firm*—Gunn & Lee

[57] ABSTRACT

A solenoid operated valve is positioned in the idle fuel mixture passage of the carburetor of an internal combustion engine of an automobile. When the automobile has reached a certain speed, if the driver releases the accelerator, a throttle linkage switch will close. Also, a vacuum sensing device will cause another switch to close thereby activating the solenoid valve to interrupt fuel flow through the idle fuel mixture passage. Thereafter, the solenoid valve will remain closed until the speed of the engine has decreased to a predetermined speed as measured by the amount of vacuum created by the engine. When the speed of the engine has decreased to the predetermined speed, or upon pushing the accelerator pedal, the solenoid valve will open again following fuel to flow through the idle fuel mixture passage. Upon turning the ignition switch OFF, the solenoid valve in the idle fuel mixture passage is closed to prevent dieselizing of the engine.

11 Claims, 4 Drawing Figures

FUEL CONTROL DEVICE FOR INTERNAL COMBUSTION ENGINE

BACKGROUND OF THE INVENTION

This invention relates to a fuel control device and, more particularly, to a fuel control device for use with an internal combustion engine of an automobile. Fuel flow through the idle fuel passage of the automobile is shut OFF during deceleration if the vacuum of the engine exceeds a predetermined value.

BRIEF DESCRIPTION OF THE PRIOR ART

Prior to the present invention, several different devices were patented that shut OFF fuel flow through the idle fuel mixture passage upon release of the accelerator pedal. A typical example is found in U.S. Pat. No. 3,626,912 wherein a valve is operated by a switch controlled by the accelerator pedal to stop fuel flow through the idle fuel passage. Flow through the idle fuel passage is reestablished if the RPM of the engine decreases below a predetermined level.

The only patent known to applicant which uses manifold pressure to control fuel flow through the idle fuel passage is U.S. Pat. No. 3,690,305 to Shimada. However, Shimada uses a switching arrangement wherein an auxiliary fuel supply system is used when fuel flow through the idle fuel passage is shut OFF to keep the engine running during deceleration. The auxiliary fuel supply as shown in Shimada requires a separate connection to the fuel pump with fuel flow from the auxiliary fuel supply being metered to counteract engine vacuum. Fuel supply to the engine is never shut OFF during deceleration as is the case in the present invention.

U.S. Pat. Nos. 3,455,260 and 3,310,044 show devices for shutting OFF the fuel flow through the idle fuel passage that are dependent upon the rotational speed of the engine. Other patents known to applicant that use intake manifold pressure to control the carburetion of an automobile include U.S. Pat. Nos. 3,568,651; 3,809,038 and 3,735,742; however, none of these patents utilize the intake manifold pressure to shut OFF fuel flow through the idle fuel passage thereby stopping combustion inside the cylinders during deceleration.

SUMMARY OF THE INVENTION

It is an object of the present invention to provide a vacuum sensing device for operating a solenoid valve that stops fuel flow through idle fuel mixture passages during deceleration of an automobile.

It is a further object of the present invention to provide in the electrical circuit of an automobile a vacuum operated switch, and a throttle linkage switch to stop fuel flow through the idle fuel mixture passage during deceleration of an automobile if the intake manifold vacuum exceeds a predetermined level, and if the accelerator pedal has been released.

It is still another object of the present invention to provide an anti-dieseling device that will stop fuel flow through the idle fuel mixture passage upon shutting OFF the ignition switch.

An accessory solenoid switch is connected through a forward gear switch so that, if the automobile is running in the forward direction, both of these switches would be closed. Upon releasing the accelerator pedal, the throttle linkage will close a switch connected in series with the forward gear switch, the accessory solenoid switch and a vacuum sensing switch. If the vacuum exceeds a predetermined level, the vacuum sensing switch will also close thereby allowing current to flow through the series of switches to energize a solenoid to close a solenoid valve in the idle fuel mixture passage. If the vacuum decreases below a second predetermined level, the vacuum sensing switch would open thereby deenergizing the solenoid valve to open the idle fuel mixture passage.

The circuit described in the preceding paragraph is connected in parallel with an anti-dieseling device that will energize the solenoid valve to stop the fuel flow through the idle fuel mixture passage once the ignition of the automobile is turned OFF. The anti-dieseling device may be controlled by a relay operated switch or solid state switching mechanism.

The vacuum sensing switch includes a diaphram operated by the intake manifold pressure. Since the vacuum operated switch is a toggle-type switch that requires a greater vacuum pressure to close than to open, the vacuum required to open the switch may vary. To increase the accuracy, an adjustable, positive displacement switch may be connected to the diaphram to insure deenergization of the solenoid valve at a given vacuum pressure.

DESCRIPTION OF THE PREFERRED EMBODIMENT

Figure 1:
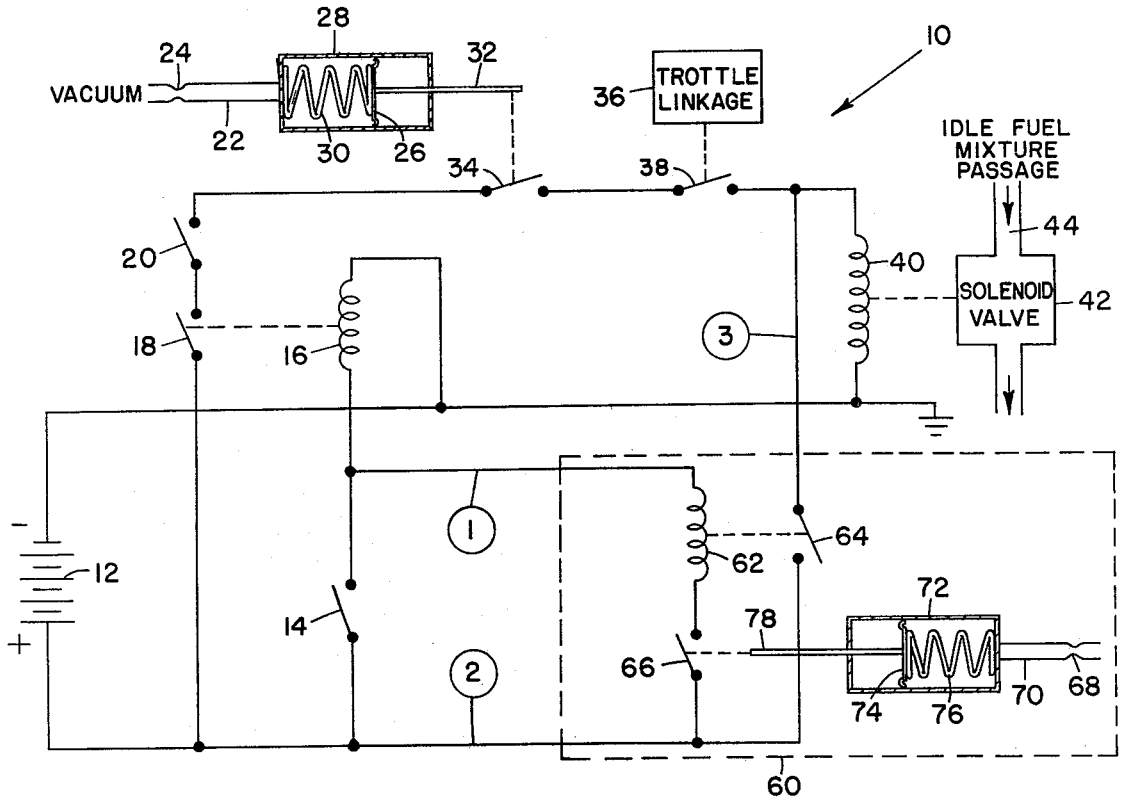
FIG. 1 is an electrical schematic of the present invention with mechanical control portions being illustrated pictorially.

Referring to FIG. 1 there is shown an electrical schematic, represented generally by reference numeral 10, for the present fuel control device. The electrical schematic 10 is connected to the automobile battery 12 with the negative side of the battery being connected to ground. Through the ignition switch 14, which closes upon turning ON the ignition key, an accessory solenoid 16 is connected from ground to the positive side of the battery 12. Upon current flow through the accessory solenoid 16, the accessory solenoid switch 18 will close. When the automobile is in a forward gear, the forward gear switch 20 will close.

After the automobile engine has been started, the intake manifold (not shown) will create a vacuum to draw additional fuel and air into the cylinder. Upon deceleration of the automobile, the vacuum in the intake manifold will be greatly increased. By use of a vacuum line 22 connected through restriction 24, the diaphram 26 inside of vacuum control device 28 will move to compress spring 30. As the diaphram 26 moves to the left, operating shaft 32 which is connected thereto will also move to the left. Movement of operating shaft 32 will open or close the vacuum switch 34. The vacuum switch 34 is a typical spring loaded toggle switch with its opening and closing points being controlled by the movement of operating shaft 32.

Assume that the present fuel control device is being used on a typical automobile. If the automobile is started and is moving in the forward direction at a normal driving speed, and the driver releases the accelerator pedal, the throttle linkage 36 will close transition switch 38. Simultaneously, upon release of the accelerator pedal, a large vacuum will be created in the engine which vacuum is fed through vacuum line 22 to the vacuum control device 28. The vacuum in the vacuum control device 28 will move the diaphram 26 against the spring 30 thereby causing the operating shaft 32 to move to the left. In a typical automobile, if the vacuum is greater than 22 inches of mercury (in/Hg), movement of the operating shaft 32 will close vacuum switch 34. The closing of the vacuum switch 34 and transition switch 38 allows current flow through coil 40 of solenoid valve 42. However, to open the spring loaded toggle-type vacuum switch 34 by operating shaft 32, the vacuum in the vacuum control device 28 must drop below approximately 17 in/Hg.

The throttle linkage 36 for the accelerator pedal which controls the transition switch 38 is set to operate during the first movement of the accelerator pedal (not shown). For a typical automobile, approximately 1/10 of an inch of movement of the accelerator pedal via the throttle linkage 36 would be sufficient to operate the transition switch 38 to insure that if any fuel (other than idle fuel) is being fed to the engine of the automobile, transition switch 38 will open thereby preventing current flow to coil 40.

Figure 4:
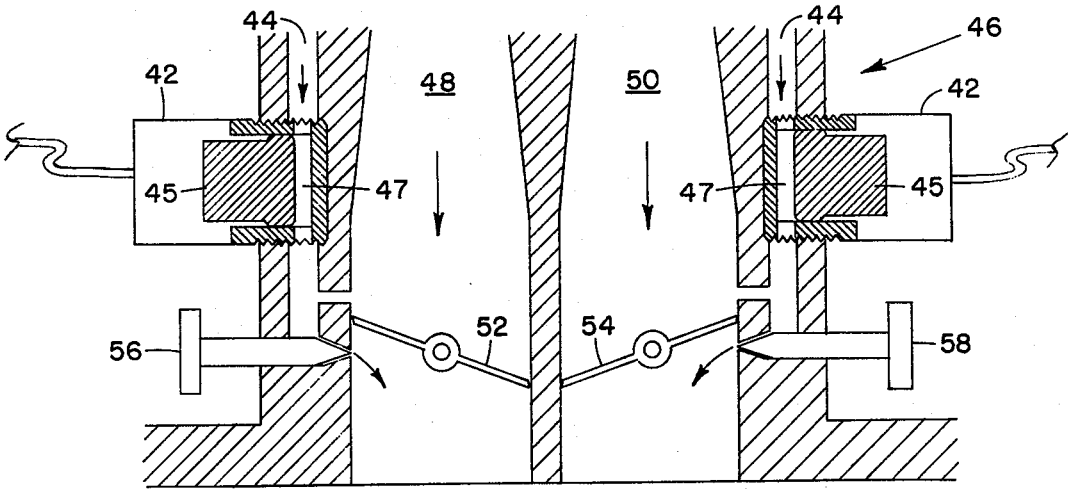
FIG. 4 is an illustrative cross-sectional view of a carburetor utilizing solenoid valves of the present invention in the idle fuel mixture passages.

Solenoid valve 42 is located in the idle fuel mixture passage 44 of the carburetor of an automobile, which carburetor is pictorially illustrated in FIG. 4 and represented generally by reference numeral 46. The carburetor 46 has two barrels 48 and 50 through which a fuel-/air mixture flows into the internal combustion engine (not shown). During normal driving of the automobile, the throttle valves 52 and 54 of barrels 48 and 50, respectively, would be opened. During deceleration, the throttle valves 52 and 54 would be closed as shown in FIG. 4.

In FIG. 4, solenoid valves 42 are shown in the open position. Upon energization of coils 40 of solenoid valves 42, plungers 45 move inward to stop idle fuel flow through passage 47 of solenoid valve 42 thereby stopping idle fuel flow through idle fuel mixture passage 44. Without solenoid valves 42, fuel would continue to flow through idle fuel mixture passage 44 and idle adjustments 56 and 58 into barrels 48 and 50, respectively.

The coil 40 may be a single coil controlling a single solenoid valve 42, or a plurality of coils 40 in parallel or series controlling a plurality of solenoid valves 42 with one for each idle fuel mixture passage 44.

It has been found in previous testing by numerous manufacturers and governmental agencies that the greatest amount of pollution occurs during the deceleration of automobiles. During deceleration of automobiles, an idle fuel mixture causes an incomplete burning. The incomplete burning of the fuel mixture results in a large number of hydrocarbons being emitted from the engine exhaust to atmosphere. In the present invention, all fuel flow to the engine is shut OFF during periods of deceleration until the engine vacuum has dropped below a predetermined point, or additional fuel is fed into the engine by pressing the accelerator pedal. Therefore, the engine of the automobile will resume running with a normal idle combustion rate if the automobile is slowed to a predetermined speed which corresponds to the lower predetermined vacuum level in the intake manifold. By shutting OFF all fuel flow to the engine during deceleration, the deceleration of the automobile is aided by the engine thereby reducing wear on the brakes of the automobile. Also by stopping fuel flow during periods of deceleration, the gas mileage of the automobile is increased.

While the solenoid valve 42 is shown as being mounted integral with carburetor 46, it may be part of a kit to retrofed carburetors wherein the idle fuel passage 44 connects external to the carburetor 46 through the solenoid valve 42. In case of external connection of the solenoid valve 42, the idle fuel mixture passage 44 must be blocked to cause fuel flow through new external passages feeding through solenoid valve 42.

Referring back to FIG. 1, the fuel control device also includes an anti-dieseling portion 60. Connected across the ignition switch 14 is a relay coil 62 that controls normally open relay contact 64. In series with relay coil 62 is a vacuum operated switch 66. The vacuum operated switch 66 is controlled by engine vacuum feeding through restriction 68 in conduit 70 to vacuum control device 72. The vacuum in vacuum control device 72 causes the diaphram 74 to move against spring 76 thereby causing shaft 78 to likewise move. Movement of the shaft 78 controls the opening and closing of vacuum operated switch 66.

Upon closing of ignition switch 14 and starting the automobile, the engine vacuum will cause vacuum operated switch 66 to close. While ignition switch 14 is closed, relay coil 62 is short circuited and has essentially no current therethrough. After stopping the automobile and turning OFF the ignition switch 14, current will then flow through accessory coil 16 and relay coil 62 thereby closing normally open relay contact 64. As the vacuum in vacuum control device 72 slowly bleeds down through restriction 68, vacuum operated switch 66 will open several seconds later after the engine has completely stopped. By holding the normally open relay contact 64 closed for a few seconds after turning OFF the ignition switch 14, relay coil 40 will have a current flow therethrough thereby holding solenoid valve 42 closed to interrupt any fuel flow through the idle fuel mixture passage 44.

Figure 2:
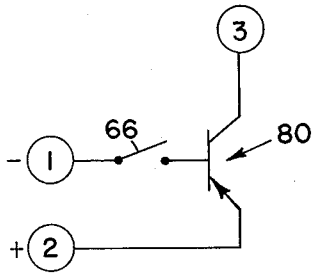
FIG. 2 is an alternative anti-dieseling device for use in FIG. 1.

Rather than using relay coil 62 and normally open relay contact 64, a solid state switching device such as transistor 80 shown in FIG. 2 may be used. While the base of transistor 80 has vacuum operated switch 66 connected therein, any other type of time delay switch that will open several seconds after the opening of the ignition switch 14 may be used. The transistor 80 would replace the relay coil 62 and normally open relay contact 64 in the electrical schematic 10 by connection at points 1, 2 and 3.

Figure 3:
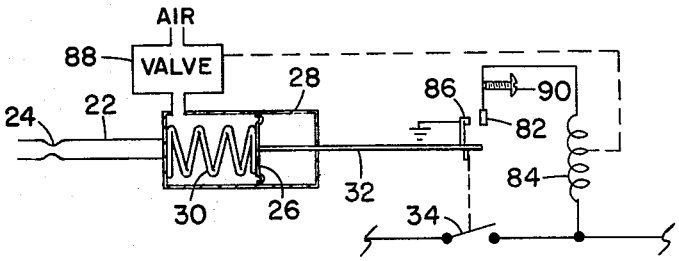
FIG. 3 is an alternative apparatus for controlling the opening of a vacuum operated switch.

Because the vacuum switch 34 is a spring loaded type of toggle switch, the repeatability of the switching points as determined by inches of mercury of vacuum in vacuum control device 28 are not very accurate. To increase the accuracy of the opening of vacuum switch 34, a positive displacement contact 82 is connected through coil 84 to the open side of vacuum switch 34 that connects to transition switch 38 as shown in FIG. 3. If positive displacement contact 82 connects through contact 86 mounted on operating shaft 32 to ground, current will flow through coil 84 which opens valve 88. The opening of valve 88 will allow air to enter vacuum control device 28 thereby driving the diaphram 26 of the vacuum control device 28 to the right. The driving of diaphram 26 to the right will open vacuum switch 34. The set point for positive displacement contact 82 may be very accurately controlled by screw adjustment 90.

Therefore, even though the critical opening of vacuum switch 34 may not be accurately set, the positive displacement contact 82 and the energization of coil 84 may be accurately set. Upon opening valve 88, vacuum switch 34 will also open which deenergizes the coil 40 of solenoid valve 42 to allow fuel flow through idle fuel mixture passage 44.

While FIG. 1 shows the anti-dieseling portion 60 connecting through the accessory solenoid 16 to ground, the connection to ground does not necessarily require an accessory solenoid 16. For example, the accessory solenoid 16 and accessory solenoid switch 18 may be replaced by normally closed contacts and normally open contacts, respectively, of the ignition switch. In such event, the contacts of the ignition switch 14 (as shown in FIG. 1) would be removed and the normally opened and closed contacts inserted. Upon turning the ignition switch ON, the normally closed contacts would open and the normally opened contacts will close; upon turning the ignition switch OFF, vice versa.

I claim:

1. A fuel control apparatus for use on vehicles powered by internal combustion engines equipped with standard components, such as a voltage source, accelerator, carburetor, ignition switch, forward gear switch, throttle linkage, accessory coil, accessory switch and idle fuel flow passage, comprising:

a vacuum operated switch means operated by intake vacuum pressure of said internal combustion engine, said vacuum operated switch means being connected in series with said accessory switch and said forward gear switch to a first side of said voltage source, said vacuum operated switch means closing at a first predetermined intake vacuum and opening at a second predetermined intake vacuum, said first predetermined intake vacuum being greater than said second predetermined intake vacuum;

transition switch means connected in series with said vacuum operated switch means, said transition switch means being operable by said throttle linkage of said vehicle to close if the accelerator of the vehicle is released;

coil means of solenoid valve means connected in series with said transition switch means to a second side of said voltage source, said solenoid valve means being located in the idle fuel passage of said vehicle for interrupting fuel flow therethrough during deceleration if intake vacuum exceeds a first predetermined level and the accelerator is released;

as long as the accelerator is released, said interruption of fuel flow will continue until intake vacuum drops to a second predetermined level.

2. The fuel control apparatus as given in claim 1 wherein said vacuum operated switch means is a spring loaded toggle-type switch, further including positive displacement switch means connected to said voltage source and operated by a vacuum diaphram device that receives intake vacuum pressure, said vacuum diaphram device also controlling said vacuum operated switch means, said positive displacement switch means being adjustable with respect to said vacuum diaphram device to close upon the vacuum reaching said second predetermined level, closure of said positive displacement switch means allowing air flow into said vacuum diaphram device to override said vacuum to open said vacuum operated switch means.

3. The fuel control apparatus as given in claim 2 wherein said positive displacement switch means includes air valve means energized by current flow through positive displacement contacts to allow air flow into said vacuum diaphram device, said air valve means being deenergized upon opening said vacuum operated switch means.

4. The fuel control apparatus as given in claim 1 including an anti-dieseling device connected in parallel to said coil means, anti-dieseling switching means connected across said ignition switch and in series with a time delay switch means, said time delay switch means opening a predetermined period of time after said ignition switch thereby energizing said coil means to close said solenoid valve means from the opening of said ignition switch until said predetermined period of time has passed to prevent dieseling.

5. The fuel control apparatus as given in claim 4 wherein said anti-dieseling switching means includes a relay coil in series with said time delay switch means, said relay coil closing a relay contact connecting said coil means to said voltage source.

6. The fuel control apparatus as given in claim 4 wherein said anti-dieseling switching means includes a transistor means for connecting said coil means to said voltage source, current flow through said transistor means to prevent dieseling being controlled by said time delay switch means.

7. The fuel control apparatus as given in claim 1 wherein said solenoid valve means is mounted in the idle fuel flow passage of the carburetor, said solenoid valve having a passage therethrough, said passage being closed upon energization of said coil means to move a plunger into said passage.

8. A fuel control apparatus for use on vehicles powered by internal combustion engines equipped with standard components, such as a voltage source, accelerator, carburetor, ignition switch means having normally opened contacts and normally closed contacts, and idle fuel flow passage, comprising:

a vacuum operated switch means operated by intake vacuum pressure of said internal combustion engine, said vacuum operated switch means being connected in series with said normally opened contacts of said ignition switch means and said forward gear switch to a first side of said voltage source, said vacuum operated switch means closing at a first predetermined intake vacuum and opening at a second predetermined intake vacuum, said first predetermined intake vacuum being greater than said second predetermined intake vacuum;

transition switch means connected in series with said vacuum operated switch means, said transition switch means being operable by said throttle linkage of said vehicle to close if the accelerator of the vehicle is released;

coil means of solenoid valve means connected in series with said transition switch means to a second side of said voltage source, said solenoid valve means being located in the idle fuel passage of said vehicle for interrupting fuel flow therethrough during deceleration if intake vacuum exceeds a first predetermined level and the accelerator is released;

as long as the accelerator is released, said interruption of fuel flow will continue until intake vacuum drops to a second predetermined level.

9. The fuel control apparatus as given in claim 8 including an anti-dieseling device connected in parallel to said coil means, anti-dieseling switching means connected in series with said normally closed contacts of said ignition switch to a second side of said voltage source, said anti-dieseling switching means also being in series with a time delay switch means, said time delay switch means opening a predetermined period of time after said ignition switch thereby energizing said coil means to close said solenoid valve means from turning OFF the ignition switch means until said predetermined period of time has passed to prevent dieseling.

10. The fuel control apparatus as given in claim 9 wherein said anti-dieseling switching means includes a relay coil in series with said time delay switch means, said relay coil closing a relay contact connecting said coil means to said voltage source.

11. The fuel control apparatus as given in claim 9 wherein said anti-dieseling switching means includes a transistor means for connecting said coil means to said voltage source, current flow through said transistor means to prevent dieseling being controlled by said time delay switch means.

* * * * *